US008556306B1

(12) United States Patent
Lin

(10) Patent No.: US 8,556,306 B1
(45) Date of Patent: Oct. 15, 2013

(54) ANTI-PICK LATCH ASSEMBLY

(75) Inventor: Hsi-Ting Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 40 days.

(21) Appl. No.: 13/476,060

(22) Filed: May 21, 2012

(51) Int. Cl.
*E05C 9/02* (2006.01)

(52) U.S. Cl.
USPC ..... 292/166; 292/32; 292/157; 292/188; 70/108; 70/109

(58) Field of Classification Search
USPC ..... 292/157, 161, 165, 166, 188, 143, 3, 4, 292/8, 26, 30, 32–37; 70/108–111
See application file for complete search history.

(56) References Cited

U.S. PATENT DOCUMENTS 4,362,328 A * 12/1982 Tacheny et al. ..... 292/36
6,945,571 B2 * 9/2005 Lin ..... 292/92
6,955,378 B2 * 10/2005 Schlack et al. ..... 292/26
7,707,862 B2 * 5/2010 Walls et al. ..... 70/107
7,788,954 B2 * 9/2010 Schumm ..... 70/107
8,286,917 B2 * 10/2012 Erickson et al. ..... 244/131
2009/0019779 A1 * 1/2009 Nakanishi et al. ..... 49/449

* cited by examiner

*Primary Examiner* — Kristina Fulton
*Assistant Examiner* — Thomas Neubauer
(74) *Attorney, Agent, or Firm* — Alan Kamrath; Kamrath IP Lawfirm, PA

(57) ABSTRACT

An anti-pick latch assembly (10) is mounted to a follower door (275) of a double door (257). The latch assembly (10) includes an actuation latch (131) normally extending beyond an end face (291) of the follower door (257) and a latch (231) movable between an unlatching position received in the follower door (275) and a latching position extending out of the follower door (275) into a groove (37) in a door frame (31). When the follower door (275) is closed while a primary door (259) of the double door (257) is closed, the actuation latch (131) is actuated to move a limiting member (90) to a locking position, moving the latch (231) of into the groove (37) of the door frame (31). The limiting member (90) in the locking position prevents the latch (231) from moving out of the groove (37) while the latch (231) is picked.

7 Claims, 13 Drawing Sheets

ANTI-PICK LATCH ASSEMBLY

BACKGROUND OF THE INVENTION

The present invention relates to an anti-pick latch assembly and, more particularly, to an anti-pick latch assembly for locking a follower door of a double door.

A double door generally includes a primary door and a follower door pivotably mounted to two vertical beams of a door frame. A lock is mounted to the primary door and includes a handle on a side of the primary door and a first latch on an end face of the primary door. The first latch can be retracted into the primary door upon pivotal movement of the handle. A latch assembly is mounted to an upper end of the follower door. The latch assembly includes an actuation latch extending beyond an end face of the follower door and a second latch normally extending beyond an upper face of the follower door. When the follower door is moving from an open position to a closed position, the second latch of the latch assembly is moved from an extended, latching position to a retracted, unlatching position by a strike mounted to the door frame. When the follower door is in the closed position, the second latch of the latch assembly is engaged in a groove in the door frame to lock the follower door. Since the first latch of the lock on the primary door is engaged with a receptacle in the follower door, the primary door can not be opened, either. Thus, the double door can be reliably locked. However, the second latch on the follower door is liable to be picked and, thus, moved to the retracted, unlatching position. As a result, the double door could be forcibly opened. Furthermore, the first and second latches may be deformed by heat during a fire and, thus, moved to the unlatching position, leading to the risks of opening of the double door and spread of the fire.

Thus, a need exists for a latch assembly for reliably locking a follower door in the closed position.

BRIEF SUMMARY OF THE INVENTION

The present invention solves this need and other problems in the field of reliable locking of a double door by providing a latch assembly including a base having two sidewalls and an intermediate wall extending between the sidewalls. Each sidewall includes first, second, and third engagement holes, with the second engagement hole located between the first engagement hole and the third engagement hole along a first axis. First and second slots are defined in the intermediate wall and spaced from each other along the first axis. The intermediate wall of the base is adapted to be mounted to an end face of a follower door of a double door. The follower door includes an interior space. The sidewalls are adapted to be received in the interior space of the follower door. The follower door is pivotable between a closed position and an open position.

A movable member is movably received between the sidewalls of the base. The movable member includes two lateral walls spaced from each other along a second axis perpendicular to the first axis. The movable member further includes a connecting portion extending between the lateral walls. Each lateral wall includes a first end and a second end spaced from the first end along the first axis. A first sliding groove is defined in the first end of each lateral wall. A second sliding groove is defined between the second end and the first sliding grooves of each lateral wall. The connecting portion includes first and second ends spaced from each other along the first axis. An actuating groove is defined in the connecting portion and located between the first end of the connecting portion and the second sliding groove of each lateral wall along the first axis. The first engagement holes of the sidewalls of the base are aligned with the first sliding grooves of the lateral walls of the movable member. The second engagement holes of the sidewalls of the base are aligned with the second sliding grooves of the lateral walls of the movable member. The actuating groove is aligned with the second slot.

A first pin extends through the first engagement holes of the sidewalls of the base and the first sliding grooves of the lateral walls of the movable member. A second pin extends through the second engagement holes of the sidewalls of the base and the second sliding grooves of the lateral walls of the movable member. The movable member is movable between an engagement position and a disengagement position along the first axis. A spacing between the first end of the connecting portion of the movable member in the engagement position and the first end of each sidewall of the base is smaller than a spacing between the first end of the connecting portion of the movable member in the disengagement position and the first end of each sidewall of the base. The actuating groove remains in a length of the second slot along the first axis.

A limiting member is pivotably received in the base and has an outer periphery. The limiting member further includes an engagement end and a pivotal portion. A first protrusion is formed on the outer periphery and located adjacent to the pivotal portion. The engagement end faces the intermediate wall of the base. A third pin extends through the third engagement holes of the sidewalls of the base and the pivotal portion of the limiting member. The limiting member is pivotable between a locking position and an unlocking position about a pivot axis defined by the third pin.

A limiting frame is fixed between the sidewalls of the base and includes a first wall and a second wall spaced from the first wall along the first axis. The limiting frame further includes a connecting wall extending between the first and second walls. The first wall includes an inner face and an outer face spaced from the inner face along the first axis. A slot extends from the inner face through the outer face of the first wall. The first and second walls are fixed to the intermediate wall of the base. The first protrusion of the limiting member extends through the slot and is received between the first and second walls. The engagement end of the limiting member is located outside of the limiting frame.

An actuation latch is movably received in the first slot of the base. The actuation latch includes a base portion having first and second ends spaced from each other along a third axis perpendicular to the first and second axes. The base portion further includes first and second sides spaced from each other along the first axis. A wedge is formed on the second end of the actuation latch. A groove is formed in the first side but spaced from the second side. The groove includes a bottom wall having an inclined section intersecting with the first side. The actuation latch is movable along the third axis between a releasing position in which the wedge is located outside of the base and a pressing position in which the wedge is received in the base. The actuation latch is adapted to be actuated by an end face of a primary door of the double door. When the follower door is in the closed position and when the end face of the primary door is aligned with the end face of the follower door, the end face of the primary door presses against the actuation latch, moving the actuation latch from the releasing position to the pressing position.

A first spring is mounted between the actuating latch and the connecting wall of the limiting frame. The first spring biases the actuation latch from the pressing position to the releasing position. A locking block is fixed to the movable member and includes a locking hole. The locking block and the movable member are jointly movable between the engagement position and the disengagement position. The locking block is spaced from the third pin along the first axis. A second spring is mounted between the locking block and the second pin and biases the locking member and the movable member from the disengagement position to the engagement position.

A connecting rod includes a first end engaged in the locking hole of the locking block and a second end. A latch includes an engagement end fixed to the second end of the connecting rod. The latch further includes a locking end having a slant face. The latch is movable between a latching position and an unlatching position along the first axis. The locking end of the latch in the unlatching position is adapted to be received in the follower door. The locking end of the latch in the latching position is adapted to extend out of the follower door into a groove in a door frame to which the double door is pivotably mounted.

When the follower door is in the open position, the latch is not aligned with the groove. When the follower door is in the closed position, the latch is aligned with the groove.

When the follower door moves from the open position to the closed position, the slant face of the latch presses against the door frame, causing movement of the latch from the latching position to the unlatching position, and the latch is moved to the latching position under action of the second spring when the follower door is in the closed position.

When the end face of the primary door is not aligned with the end face of the follower door, the actuation latch is in the releasing position, the first protrusion of the limiting member abuts against the first side of the actuation latch, the limiting member is in the unlocking position, the engagement end of the limiting member is located outside of a movement path of the movable member between the engagement position and the disengagement position, allowing the movable member to be moved from the engagement position to the disengagement position via the actuating groove to cause movement of the latch from the latching position to the unlatching position.

When the end face of the primary door is aligned with the end face of the follower door, the actuation latch is in the pressing position and compresses the first spring, the groove of the actuation latch is aligned with the first protrusion of the limiting member, the limiting member is in the locking position, the engagement end of the limiting member is located in the movement path of the movable member, preventing the movable member from being moved from the engagement position to the disengagement position via the actuating groove to avoid the latch from moving form the latching position to the unlatching position, avoiding picking of the latch.

When the actuation latch is in the pressing position, if the primary door is moved to a position in which the end face of the primary door is not aligned with the end face of the follower door, the actuation latch is moved by the first spring from the pressing position to the releasing position, the first inclined section of the actuation latch pushes the first protrusion of the limiting member, causing movement of the limiting member from the locking position to the unlocking position about the pivot axis defined by the third pin, allowing movement of the movable member from the engagement position to the disengagement position.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
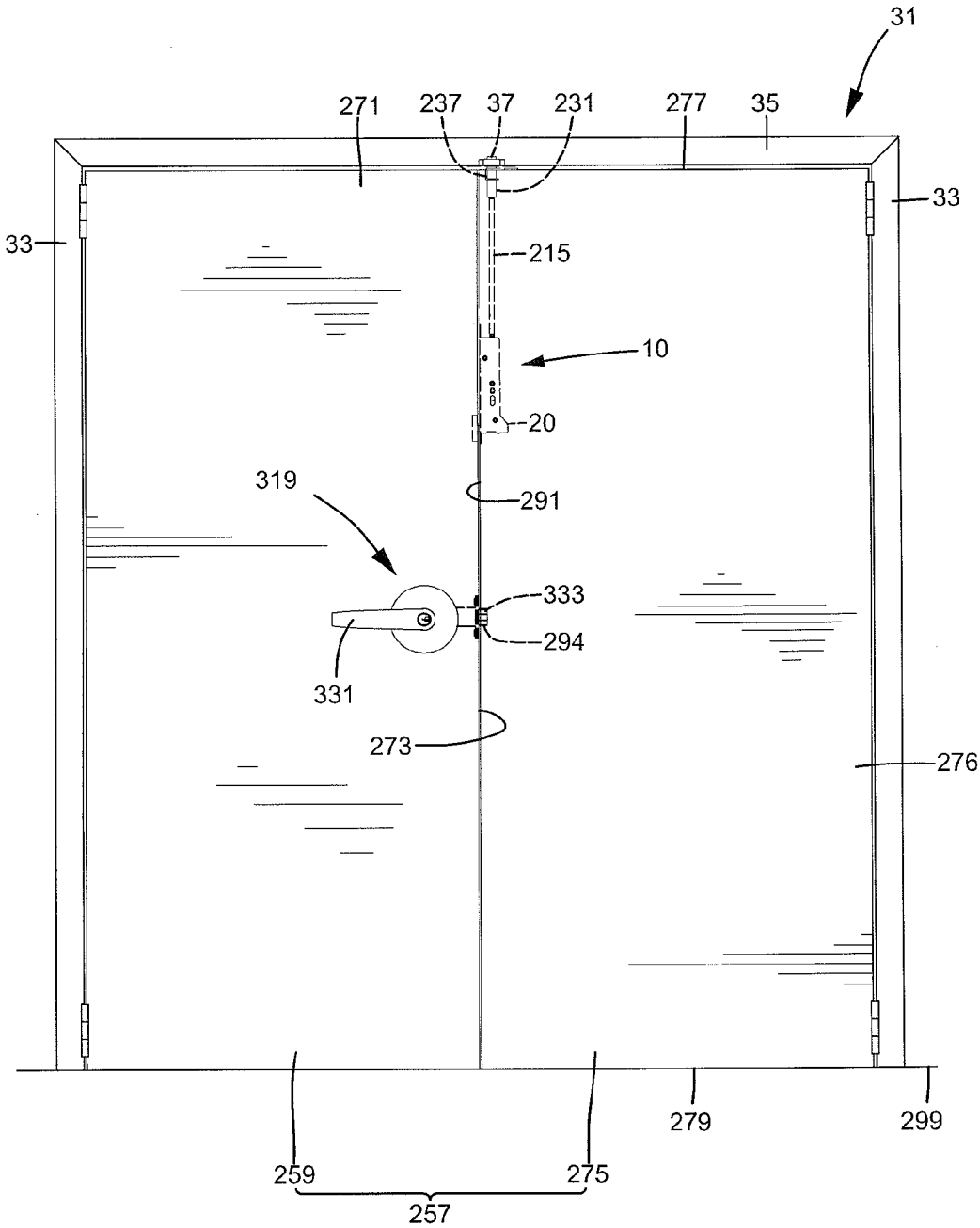
FIG. 1 shows a diagrammatic front view of a double door to which a latch assembly according to the present invention is mounted.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "top", "bottom", "inner", "outer", "end", "portion", "section", "vertical", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIG. 1 shows a latch assembly 10 mounted to a double door 257. Double door 257 is mounted to a door frame 31 on a floor or ground 299. Door frame 31 includes two spaced vertical beams 33 on ground 299 and a top beam 35 extending between upper ends of vertical beams 33. Top beam 35 includes a bottom side 361 having a groove 37. A strike 359 (FIG. 6) is mounted to top beam 35 and includes a base portion 371 fixed to bottom side 361 of top beam 35. An extension 373 is arcuate and extends from an end of base portion 371. Extension 373 extends away from top beam 35 and includes a distal end spaced from a lateral side of top beam 35 perpendicular to bottom side 361. A slot 375 is defined in a section of base portion 371 and aligned with groove 37. A positioning portion 377 extends from an edge of slot 375 into groove 37 and abuts a side of groove 37.

In the form shown, double door 257 includes a primary door 259 pivotably mounted to one of vertical beams 33 and a follower door 275 pivotably mounted to the other vertical beam 33. Follower door 275 includes an interior space 293. Primary door 259 includes two sides 271 and an end face 273 extending between sides 271 and extending perpendicularly to ground 299. Follower door 275 includes two sides 276, a top face 277 extending between sides 276 and facing top beam 35, and a bottom face 279 extending between sides 276 and facing ground 299. Top face 277 includes a mounting hole 295 in communication with interior space 293. Follower door 275 further includes an end face 291 extending between sides 276 and between top and bottom faces 277 and 279. An engagement hole 297 and a receptacle 294 are defined in end face 291. Follower door 275 is pivotable about a first axis X perpendicular to ground 299 between an open position (FIG. 6) and a closed position (FIGS. 10-13). When follower door 275 is in the open position, mounting hole 295 is not aligned with groove 37. When follower door 275 is in the closed position, mounting hole 295 is aligned with groove 37. Furthermore, strike 359 is located between top face 277 of follower door 275 and top beam 35. Extension 373 is located in a path between the open and closed positions of follower door 275.

Figure 4:
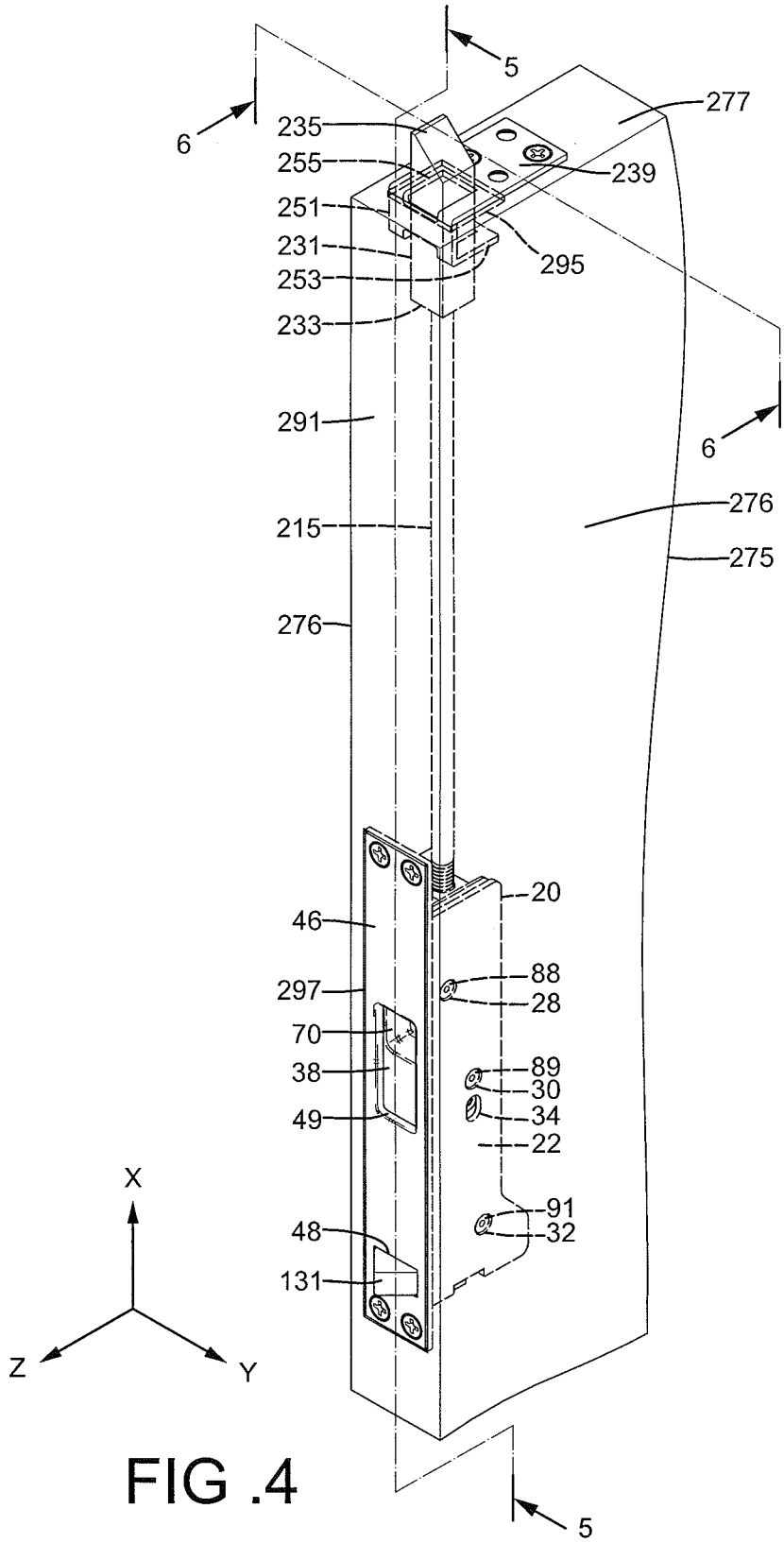
FIG. 4 shows a partial, perspective view of the double door of FIG. 1.
Figure 5:
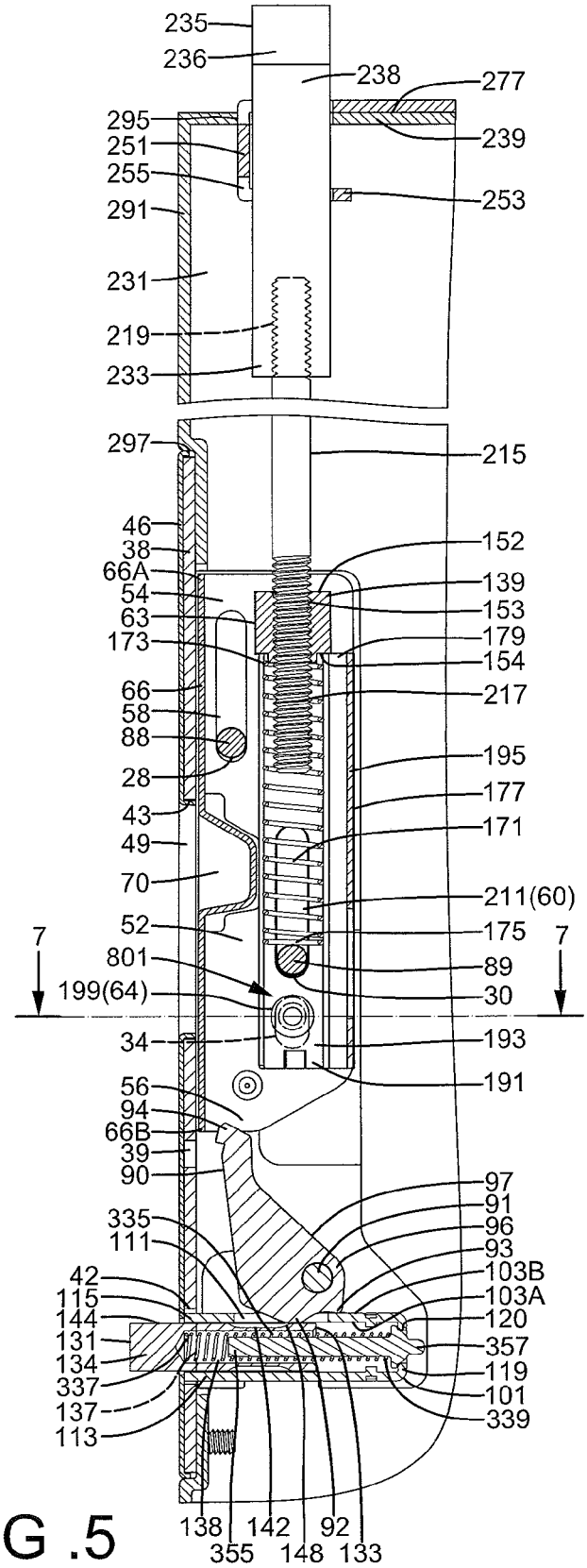
FIG. 5 shows a cross sectional view taken along section line 5-5 of FIG. 4.

A door lock 319 is mounted to primary door 259. Door lock 319 can be of any desired form as conventional including but not limited to of a commercially available type. In the form shown, door lock 319 includes a latch 333 and a handle 331 operatively connected to latch 333. Handle 331 is located on one of sides 271 of primary door 259. Pivotal movement of handle 331 causes movement of latch 333 from an extended position outside of end face 273 of primary door 259 to a retracted position inside of primary door 259. When follower door 275 is in the closed position, end face 273 of primary door 259 is aligned with end face 291 of follower door 275, with a gap existed between end faces 273 and 291, and with latch 333 engaged in receptacle 294 of follower door 275. A coupling member 237 is mounted in mounting hole 295 of follower door 275 (FIGS. 4 and 5). Coupling member 237 includes a first portion 239, a second portion 251, and a third portion 253. Second portion 251 extends perpendicularly to an end of first portion 239 and an end of third portion 253, with first and third portions 239 and 253 parallel to and spaced from each other. A receiving hole 255 is defined in each of first and third portions 239 and 253, with receiving hole 255 of first portion 239 aligned with receiving hole 255 of third portion 253. First portion 239 of coupling member 237 is fixed to top face 277 of follower door 275. Second and third portions 251 and 253 extend through mounting hole 295 into interior space 293 of follower door 275.

Figure 2:
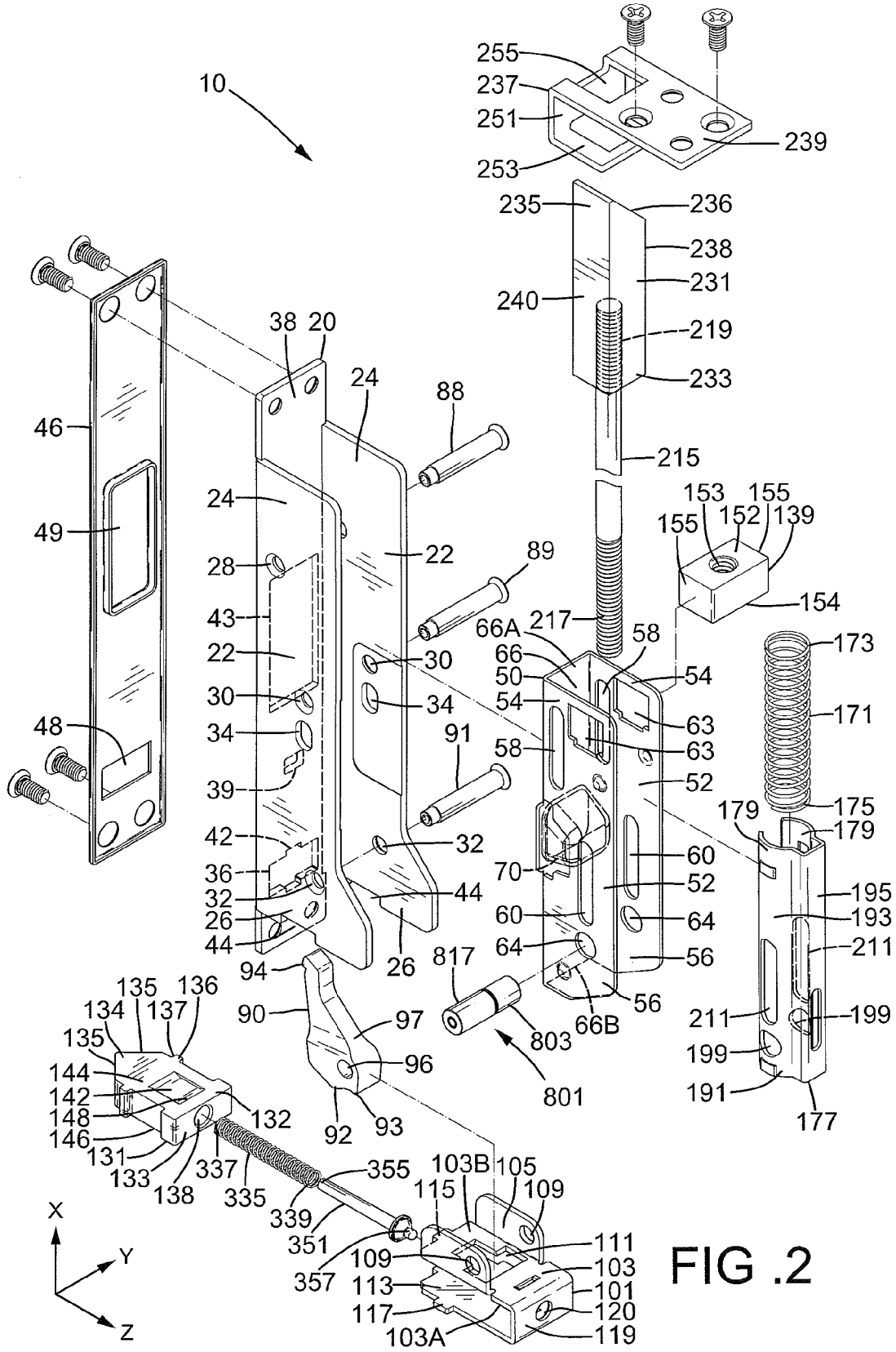
FIG. 2 shows an exploded, perspective view of the latch assembly of FIG. 1.

In the form shown, latch assembly 10 is mounted in a location adjacent to top face 277 of follower door 275. Latch assembly 10 includes a base 20 (FIG. 2) having two sidewalls 22 spaced along a second axis Y perpendicular to first axis X and an intermediate wall 38 extending between sidewalls 22. Each sidewall 22 includes a first end 24 and a second end 26 spaced from first end 24 along first axis X. Each sidewall 22 further includes a first engagement hole 28 located adjacent to first end 24, a second engagement hole 30 located between first engagement hole 28 and second end 26, and a third engagement hole 32 located in second end 26. Each sidewall 22 further includes a coupling hole 34 located between second engagement hole 30 and third engagement hole 32 and adjacent to second engagement hole 30. A first slot 36 is defined in intermediate wall 38 and adjacent to second end 26 of each sidewall 22. First slot 36 includes two edges spaced along first axis X, with a first engagement groove 42 defined in each edge of first slot 36. A second slot 43 is defined in intermediate wall 38 and between first slot 36 and first end 24 of each sidewall 22. Intermediate wall 38 further includes a positioning groove 39 between first and second slots 36 and 43. Each sidewall 22 further includes a second engagement groove 44 in second end 26.

In the form shown, a faceplate 46 is mounted to intermediate wall 38, with sidewalls 22 and faceplate 46 located on two sides of intermediate wall 38. Faceplate 46 includes a first opening 48 aligned with first slot 36 and a second opening 49 aligned with second slot 43. Intermediate wall 38 of base 20 and faceplate 46 are engaged in engagement hole 297 of follower door 275 (FIGS. 4 and 5), with sidewalls 22 received in interior space 293 of follower door 275. Screws are extended through faceplate 46 and intermediate wall 38 into end face 291 of follower door 275 to fix base 20 to follower door 275, with first end 24 of each sidewall 22 facing top beam 35 (FIG. 1).

According to the form shown, latch assembly 10 further includes a movable member 50 movably received between sidewalls 22 of base 20. Movable member 50 includes two lateral walls 52 spaced from each other along second axis Y and a connecting portion 66 extending between lateral walls 52. Each lateral wall 52 includes a first end 54 and a second end 56 spaced from first end 54 along first axis X. Each lateral wall 52 further includes a first sliding groove 58 in first end 54 and a second sliding groove 60 between second end 56 and first sliding groove 58. Each lateral wall 52 further includes a first mounting hole 63 in first end 54 and spaced from first sliding groove 58 in a third axis Z perpendicular to first and second axes X and Y. Each lateral wall 52 further includes a second mounting hole 64 between second end 56 and second sliding groove 60. Connecting portion 66 includes a first end 66A and a second end 66B spaced from first end 66A along first axis X. Connecting portion 66 further includes an actuating groove 70 between first end 66A and second sliding groove 60 along first axis X. Lateral walls 52 of movable member 50 are received between sidewalls 22 of base 20, with first engagement holes 28 of sidewalls 22 aligned with first sliding grooves 58 of lateral walls 52, with second engagement holes 30 of sidewalls 22 aligned with second sliding grooves 60, and with actuating groove 70 aligned with second slot 43.

Figure 9:
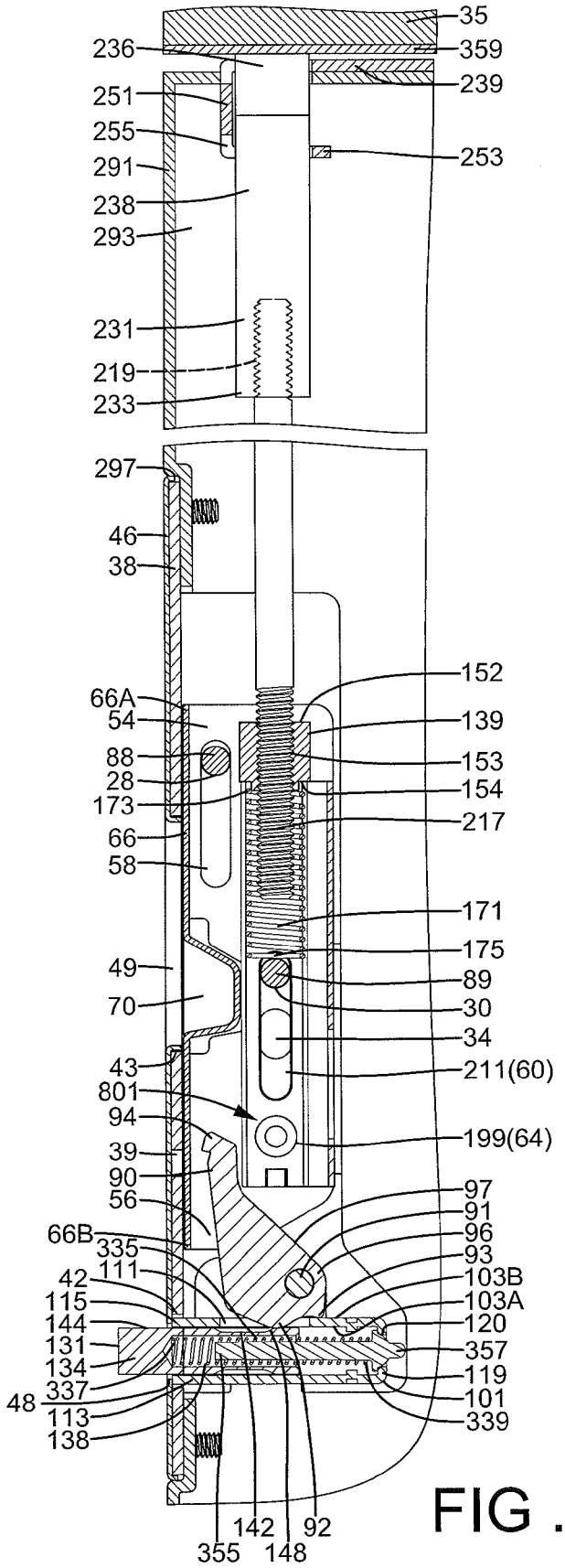
FIG. 9 shows across-sectional view taken along section line 9-9 of FIG. 8.

In the form shown, a first pin 88 extends through first engagement holes 28 of sidewalls 22 of base 20 and first sliding grooves 58 of lateral walls 52 of movable member 50. A second pin 89 extends through second engagement holes 30 of sidewalls 22 of base 20 and second sliding grooves 60 of lateral walls 52 of movable member 50. First and second pins 88 and 89 maintain connecting portion 66 of movable member 50 to be parallel to intermediate wall 38 of base 20 and allows movable member 50 to move along first axis X between an engagement position (FIG. 5) and a disengagement position (FIG. 9). A spacing between first end 66A of connecting portion 66 of movable member 50 in the engagement position and first end 24 of each sidewall 22 of base 20 is smaller than a spacing between first end 66A of connecting portion 66 of movable member 50 in the disengagement position and first end 24 of each sidewall 22 of base 20. However, actuating groove 70 is located in a length of second slot 43 along first axis X no matter movable member 50 is in the engagement position or the disengagement position.

According to the form shown, latch assembly 10 further includes a limiting member 90 pivotably received in base 20 and having an outer periphery 97. Limiting member 90 further includes an engagement end 94 and a pivotal portion 96. A first protrusion 92 is formed on outer periphery 97 and adjacent to pivotal portion 96. A second protrusion 93 is formed on outer periphery 97, with first protrusion 92 located between engagement end 94 and second protrusion 93. A third pin 91 extends through third engagement holes 32 of base 20 and pivotal portion 96 of limiting member 90, with engagement end 94 of limiting member 90 facing intermediate wall 38 of base 20. Thus, limiting member 90 is pivotable about a pivot axis defined by third pin 91 between a locking position (FIG. 12) and an unlocking position (FIG. 5). When limiting member 90 is in the locking position, engagement end 94 of limiting member 90 is engaged with positioning groove 39 of base 20 and in a movement path of movable member 50 between the engagement position and the disengagement position. Thus, movable member 50 can not move from the engagement position to the disengagement position. On the other hand, when limiting member 90 is in the unlocking position, engagement end 94 of limiting member 90 is disengaged from positioning groove 39 of base 20 and located outside of the movement path of the movable member 50. Thus, movable member 50 can move between the engagement position and the disengagement position.

According to the form shown, latch assembly 10 further includes a limiting frame 101 fixed between sidewalls 22 of base 20 and having substantially U-shaped cross sections. Limiting frame 101 includes a first wall 103 and a second wall 113 spaced from first wall 103 along first axis X. Limiting frame 101 further includes a connecting wall 119 extending between first and second walls 103 and 113. First wall 103 includes an inner face 103A and an outer face 103B spaced from inner face 103A along first axis X. A slot 111 extends from inner face 103A through outer face 103B. A positioning hole 120 is defined in connecting wall 119. A first engagement protrusion 115 is formed on a distal edge of each of first and second walls 103 and 113. Each of first and second walls 103 and 113 includes two lateral edges spaced along second axis Y. A second engagement protrusion 117 is formed on each lateral edge of second wall 113. Two wings 105 respectively extend from the lateral edges of first wall 103, with each wing 105 having a pivot hole 109.

In the form shown, each first engagement protrusion 115 of limiting frame 101 is engaged with one of first engagement grooves 42 of base 20. Each second engagement protrusion 117 of limiting frame 101 is engaged with one of second engagement grooves 44 of base 20. Thus, first and second walls 103 and 113 of limiting frame 101 are flush with the edges of first slot 36. Pivot holes 109 of limiting frame 101 are aligned with third engagement holes 32 of base 20. Third pin 91 extends through pivot holes 109, third engagement holes 32, and pivotal potion 96 of limiting member 90, fixing limiting frame 101 between sidewalls 22 of base 20, with pivotal portion 96 of limiting member 90 located between wings 105, with first protrusion 92 of limiting member 90 extending through slot 111 and received between first and second walls 103 and 113, with engagement end 94 of limiting member 90 located outside of limiting frame 101.

Figure 12:
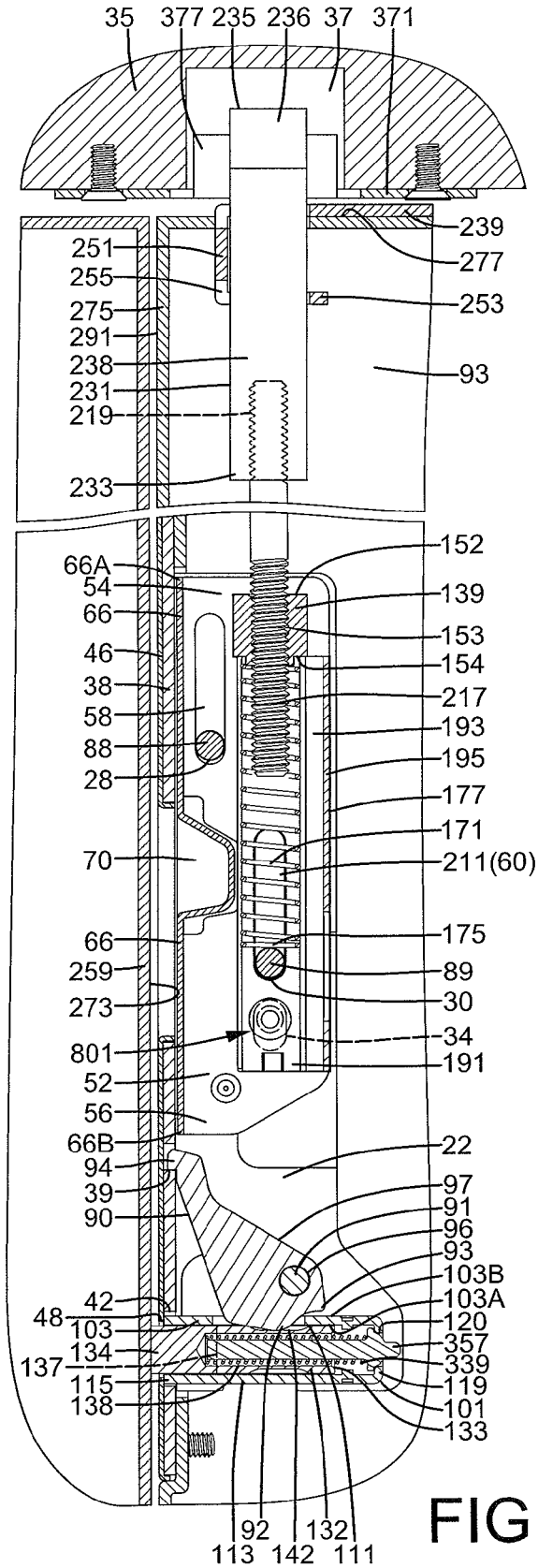
FIG. 12 shows a view similar to FIG. 11, illustrating movement after the primary door is closed.
Figure 13:
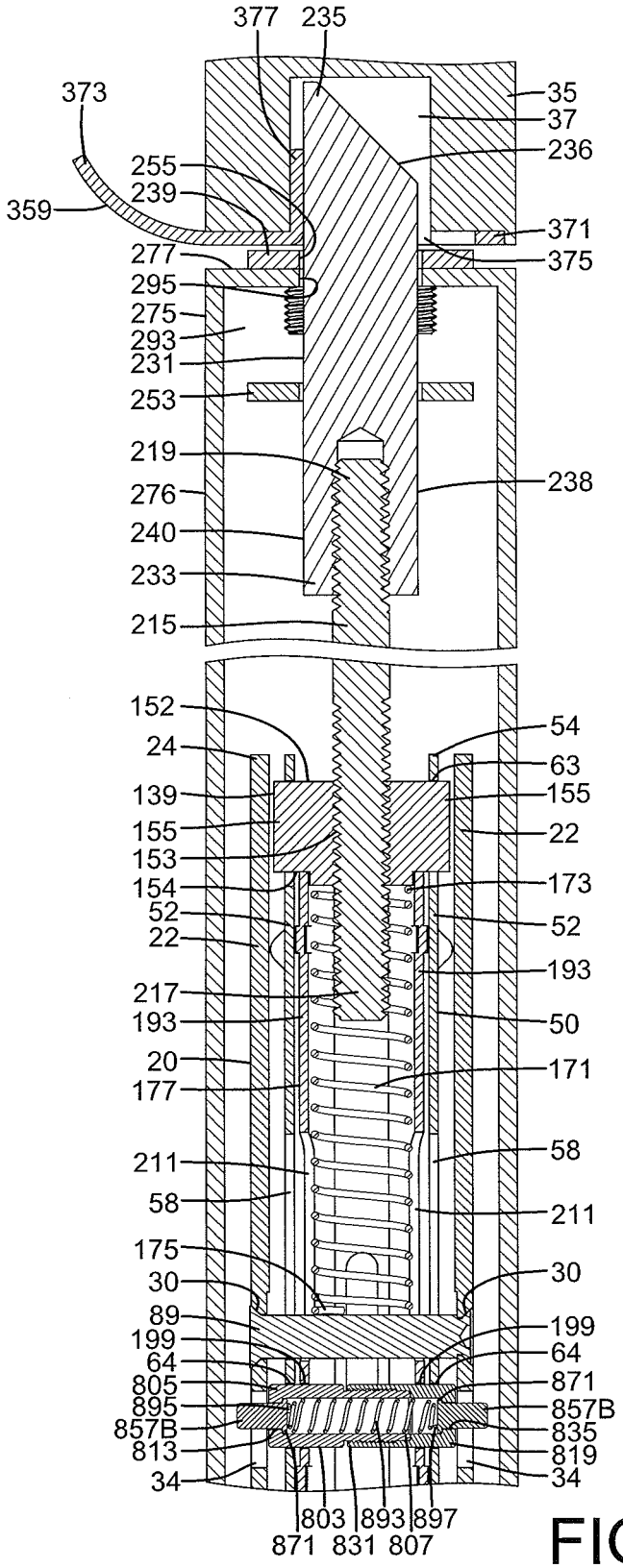
FIG. 13 shows a view similar to FIG. 10, with first and second safety pins of the safety device moved to an extended position during a fire.

According to the form shown, latch assembly 10 further includes an actuation latch 131 movably received in first slot 36 of base 20. Actuation latch 131 includes a base portion 132 having a first end 133 and a second end 137 spaced from first end 133 along third axis Z. Base portion 132 further includes first and second sides 144 and 146 extending between first and second end 133 and 137, with first side 144 spaced from second side 146 along first axis X. Second end 137 of base portion 132 includes a first end portion 136 and a second end portion 136 spaced from first end portion 136 along second axis Y. A wedge 134 is formed on second end 137 and located between end portions 136. Wedge 134 includes substantially triangular cross sections and includes two actuating faces 135 meeting at an edge. Actuating faces 135 are located between end portions 136 along second axis Y. A groove 142 is formed in first side 144 but spaced from second side 146. Groove 142 includes a bottom wall having an inclined section 148 intersecting with and at an obtuse angle to first side 144. A hole 138 extends from first end 133 towards but spaced from second end 137 of actuation latch 131. Base portion 132 and first and second end portions 136 are located between first and second walls 103 and 113 of limiting frame 101. Actuating latch 131 is movable along third axis Z between a releasing position in which wedge 134 extends out of base 20 (FIG. 5) and a pressing position in which wedge 134 is received in base 20 (FIG. 12). When actuation latch 131 is in the releasing position, second end 137 abuts an inner face of intermediate wall 38 of base 20.

According to the form shown, a guiding rod 351 is mounted between actuation latch 131 and limiting frame 101. Guiding rod 351 includes a first positioning end 355 engaged with hole 138 of actuation latch 131 and a second positioning end 357 engaged with positioning hole 120 of limiting frame 101. Second positioning end 357 has an outer diameter larger than that of first positioning end 355. A spring 335 is mounted around guiding rod 351 and located between actuation latch 131 and limiting frame 101. Spring 335 includes a first end 337 abutting against an end wall of hole 138 and a second end 339 abutting against second positioning end 357. Spring 335 biases actuation latch 131 from the pressing position to the releasing position. Guiding rod 351 avoids distortion of spring 335 while actuation latch 131 moves from the releasing position to the pressing position and compresses spring 335.

According to the form shown, a locking block 139 is mounted to lateral walls 52 of movable member 50. Locking block 139 includes a first surface 152 and a second surface 154 spaced from first surface 152 along first axis X. Locking block 139 further includes first and second ends 155 extending between first and second surfaces 152 and 154, with first and second ends 155 spaced from each other along second axis Y. A locking hole 153 in the form of a screw hole extends from first surface 152 through second surface 154. However, instead of a through-hole in the form shown, locking hole 153 can be defined in first surface 152 but spaced from second surface 154. Each of first and second ends 155 of locking block 139 is engaged with one of first mounting holes 63 of movable member 50. However, locking block 139 does not extend beyond sidewalls 22 of base 20, and locking hole 153 of locking block 139 is located between lateral walls 52 of movable member 50. Locking block 139 is jointly movable with movable member 50 between the engagement position and the disengagement position along first axis X.

In the form shown, a spring 171 is mounted between locking block 139 and second pin 89. Spring 171 includes a first end 173 abutting against second surface 154 of locking block 139 and a second end 175 abutting against second pin 89. Spring 171 biases movable member 50 and locking block 139 from the disengagement position to the engagement position (FIG. 5).

According to the form shown, latch assembly 10 further includes a restraining member 177 mounted in movable member 50. Restraining member 177 includes two sides 193 spaced from each other along second axis Y. Restraining member 177 further includes a connecting section 195 extending between sides 193. Spring 171 is received in a space defined by sides 193 and connecting section 195 of restraining member 177. Each side 193 includes a first end 179 and a second end 191 spaced from first end 179 along first axis X. Each side 193 further includes a slot 211 between first and second ends 179 and 191. A mounting hole 199 is defined in second end 191 of each side 193, with slot 211 located between first end 179 and mounting hole 199. Sides 193 of restraining member 177 are located between lateral walls 52 of movable member 50, with slots 211 aligned with second sliding grooves 60, and with mounting holes 199 aligned with second mounting holes 64. Second pin 89 extends through second engagement holes 30 of base 20, second sliding grooves 60 of movable member 50, and slots 211 of restraining member 177. First end 179 of each side 193 of restraining member 177 has an end face abutting second surface 154 of locking block 139. Second end 191 of each side 193 of restraining member 177 is adjacent to second end 56 of movable member 50. Slots 211 allow joint movement of restraining member 177 and movable member 50 between the engagement position and the disengagement position. Restraining member 177 avoids distortion of spring 171 while movable member 50 moves towards the engagement position and compresses spring 171.

Figure 8:
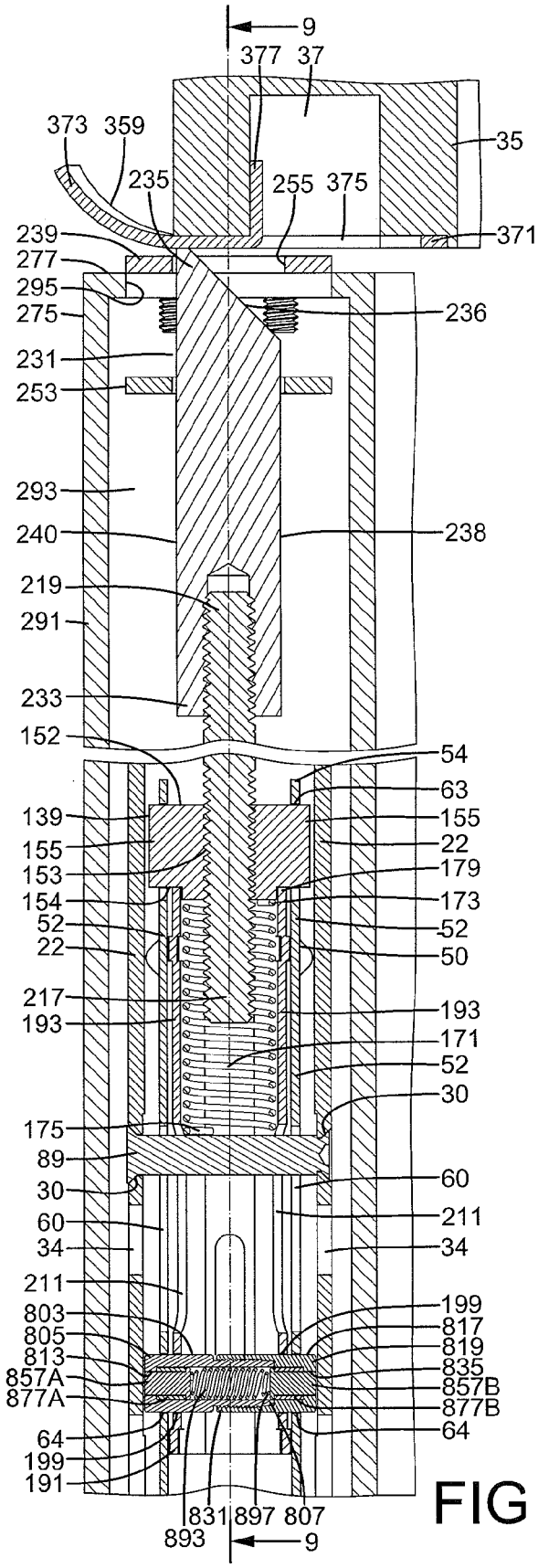
FIG. 8 shows a view similar to FIG. 6, with a follower door pivoted, and with a latch pivoted to a latching position.

In the form shown, a connecting rod 215 is engaged with locking block 139. Specifically, connecting rod 215 includes a first end 217 having an outer threading engaged with locking hole 153 of locking block 139. Connecting rod 215 further has a second end 219 to which a latch 231 is engaged. Latch 231 includes an engagement end 233 engaged with second end 219 of connecting rod 215 and a locking end 235. Latch 231 further includes a first surface 238 and a second surface 240 spaced from first surface 238 along second axis Y. Locking end 235 has a slant face 236 at an obtuse angle (about 135°) to first surface 238 and at an acute angle (about 45°) to second surface 240. First surface 238 and slant face 236 of latch 231 face extension 373 of strike 359. Connecting rod 215 and latch 231 are movable together with locking block 139 and movable member 50 along first axis X between the engagement position and the disengagement position. When movable member 50 is in the engagement position, latch 231 is in a latching position (FIG. 5). When movable member 50 is in the disengagement position, latch 231 is in an unlatching position (FIGS. 8 and 9). When latch 231 is in the unlatching position, locking end 235 is received in mounting hole 295 of follower door 275. When latch 231 is in the latching position, locking end 235 of latch 231 extends out of mounting hole 295 of follower door 275. Latch 231 is not aligned with groove 37 when follower door 275 is in the open position. Latch 231 is aligned with groove 37 when follower door 275 is in the closed position.

Figure 3:
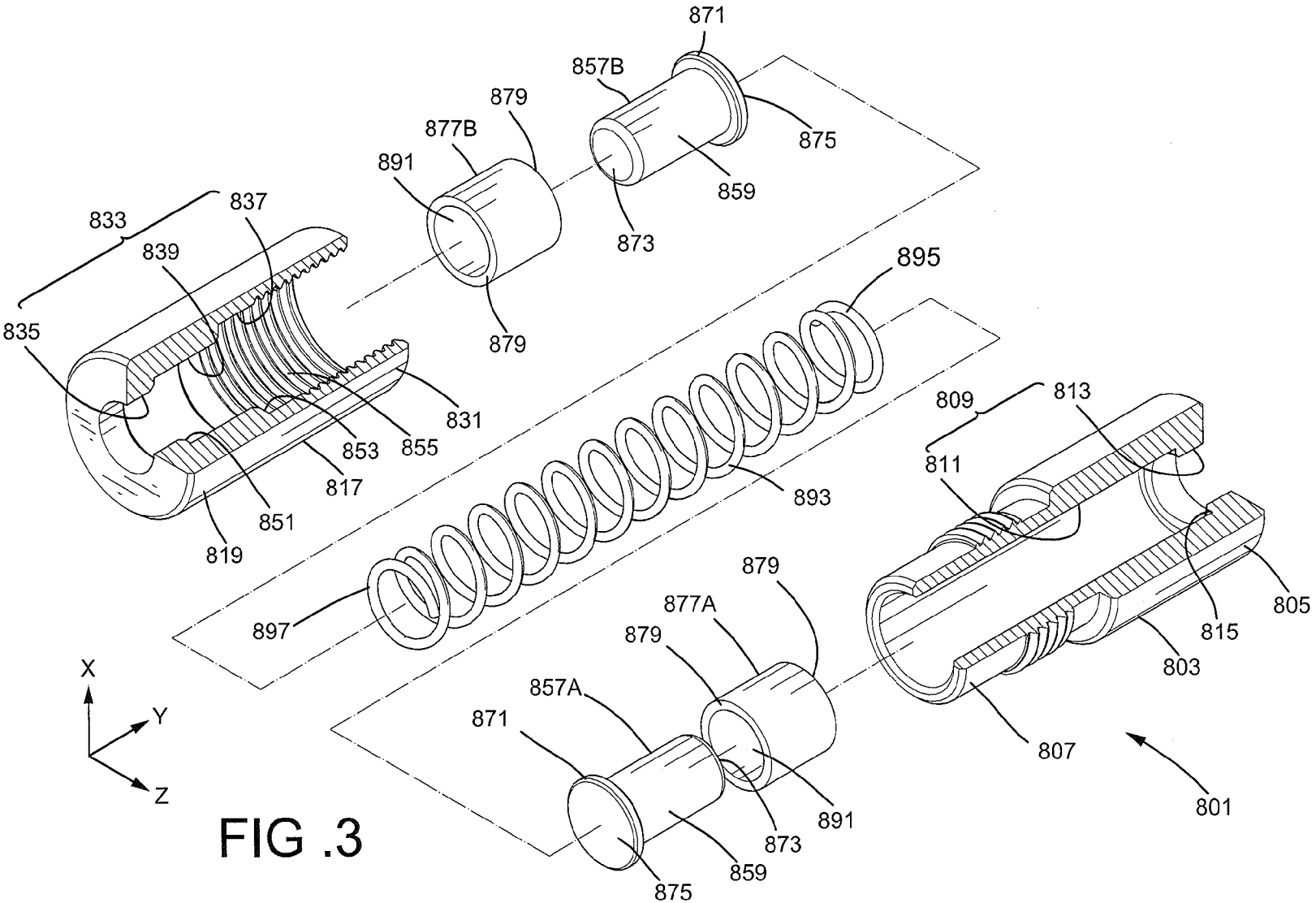
FIG. 3 shows an exploded, perspective view of a safety device of the latch assembly of FIG. 1.

According to the form shown, latch assembly 10 further includes a safety device 801 (FIGS. 3 and 7) mounted to movable member 50 and restraining member 177. Safety device 801 includes first and second sleeves 803 and 817 engaged with each other. First sleeve 803 includes a first end 805 and a second end 807 spaced from first end 805 along second axis Y and having a diameter smaller than that of first end 805 and having an outer thread. A receiving hole 809 extends from first end 805 through second end 807. Receiving hole 809 includes a smaller section 813 extending from first end 805 towards but spaced from second end 807 and a larger section 811 extending from second end 807 through smaller section 813 and having a diameter larger than smaller section 813, with a shoulder 815 formed in an intersection of larger and smaller sections 811 and 813. Second sleeve 817 includes a first end 819 and a second end 831 spaced from first end 819 along second axis Y. A mounting hole 833 extends from first end 819 through second end 831. Mounting hole 833 includes a first hole section 835 extending from first end 819 towards but spaced from second end 831, a second hole section 837 extending from second end 831 towards but spaced from first end 819, and an intermediate hole section 839 between first and second hole sections 835 and 837, with a first abutment face 851 formed at an intersection of first hole section 835 and intermediate hole section 839, and with a second abutment face 853 formed at an intersection of intermediate hole section 839 and second hole section 837. Second hole section 837 includes an inner threading 855 spaced from second abutment face 853.

Figure 7:
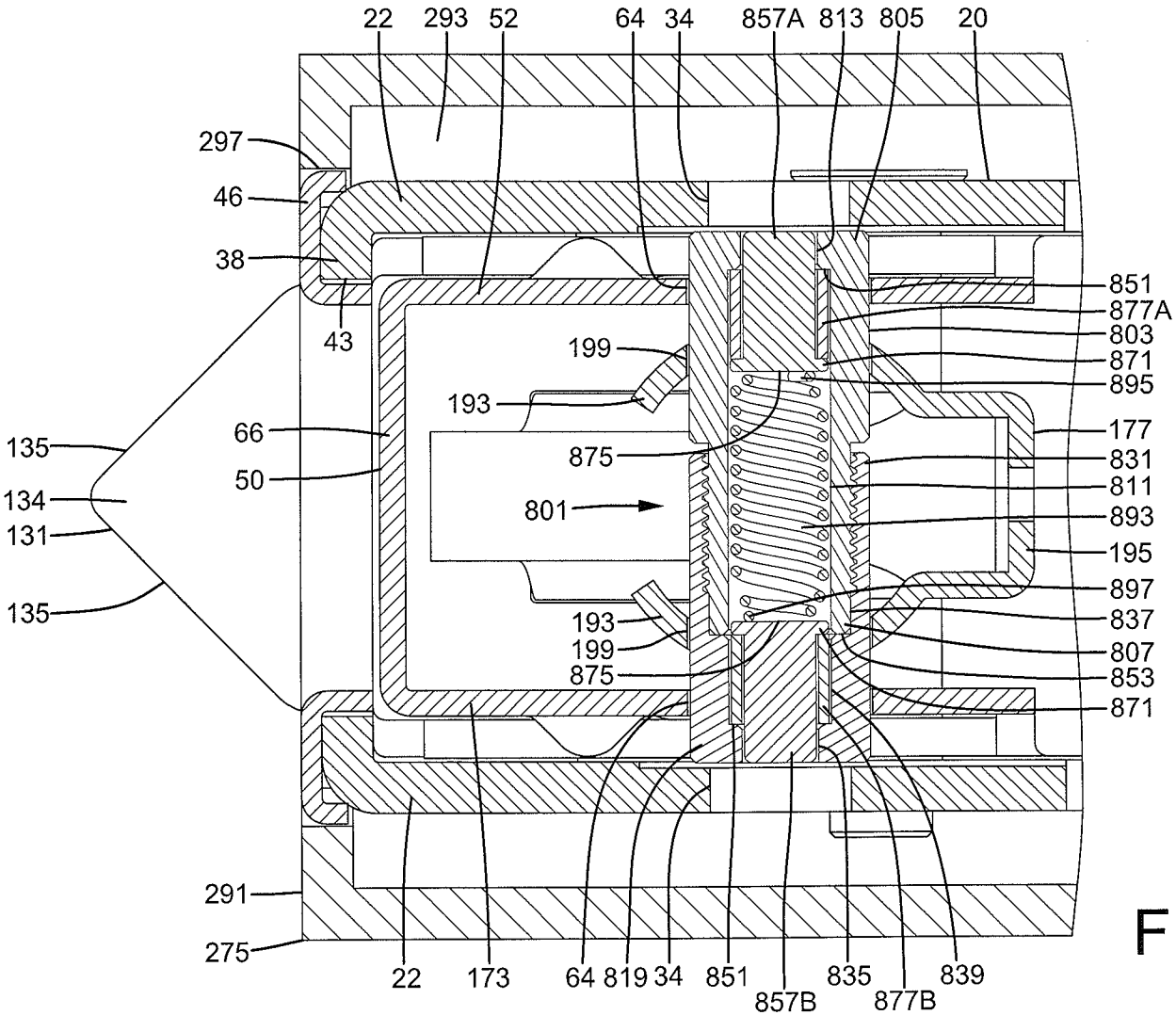
FIG. 7 shows a cross sectional view taken along section line 7-7 of FIG. 5.

Second end 807 of first sleeve 803 of safety device 801 is threaded into second hole section 837 of second sleeve 817 and engaged with inner threading 855. An end face of second end 807 of first sleeve 803 abuts second abutment face 853 of second sleeve 817 (FIG. 7).

According to the form shown, safety device 801 further includes first and second stops 877A and 877B respectively mounted in first and second sleeves 803 and 817. First and second stops 877A and 877B are made of a material having a melting point lower than first and second sleeves 803 and 817, such as plastic. Each of first and second stops 877A and 877B has two ends 879 and a through-hole 891 extending from an end 879 through the other end 879. First stop 877A has an outer diameter slightly smaller than the inner diameter of larger section 811 of first sleeve 803. First stop 877A is received in larger section 811 of first stop 877A, with an end 879 abutting shoulder 815. Second stop 877B has an outer diameter smaller than the inner diameter of intermediate hole section 839 of second sleeve 817. Second stop 877B is received in intermediate hole section 839 of second sleeve 817, with an end 879 abutting first abutment face 851. A length of second stop 877B along second axis Y is equal to a length of intermediate hole section 839 of second sleeve 817 along second axis Y.

According to the form shown, safety device 801 further includes first and second safety pins 857A and 857B respectively mounted in first and second sleeves 803 and 817. Each of first and second safety pins 857A and 857B has a cylindrical shank 859 and a flange 871 on an end of shank 859 and having an end face 875. Shank 859 further has a distal end 873 away from flange 871. The melting point of each of first and second safety pins 857A and 857B are higher than that of first and second stops 877A and 877B.

First safety pin 857A is mounted in receiving hole 809 of first sleeve 803, with shank 859 of first safety pin 857A extending through through-hole 891 of first stop 877A. A length of shank 859 along second axis Y is equal to a sum of a length of first stop 877A and a length of smaller section 813 of receiving hole 809 along second axis Y. An outer diameter of shank 859 of first safety pin 857A is slightly smaller than the inner diameter of smaller section 813 of receiving hole 809 of first sleeve 803 and slightly smaller than through-hole 891 of first stop 877A. An outer diameter of flange 871 of first safety pin 857A is slightly smaller than the inner diameter of larger section 811 of receiving hole 809 of first sleeve 803 but larger than the inner diameter of through-hole 891 of first stop 877A, such that flange 871 of first safety pin 857A abuts an end 879 of first stop 877A distant to shoulder 815. Furthermore, distal end 873 of shank 859 is extended through smaller section 813 of first sleeve 803, and an end face of distal end 873 of shank 859 of first safety pin 857A is flush with the end face of first end 805 of first sleeve 803.

Second safety pin 857B is mounted in mounting hole 833 of second sleeve 817. A length of shank 859 of second safety pin 857B along second axis Y is equal to the sum of a length of second stop 877B and a length of first hole section 835 of mounting hole 833 along second axis Y. An outer diameter of shank 859 of second safety pin 857B is slightly smaller than the inner diameter of first hole section 835 of mounting hole 833 of second sleeve 817 and slightly smaller than the inner diameter of through-hole 891 of second stop 877B. An outer diameter of flange 871 of second safety pin 857B is slightly smaller than the inner diameter of second hole section 837 of mounting hole 833 of second sleeve 817 but larger than the inner diameter of through-hole 891 of second stop 877B, such that flange 871 of second safety pin 857B abuts an end 879 of second stop 877B distant to first abutment face 851. Furthermore, distal end 873 of shank 859 of second safety pin 857B is extended through first hole section 835 of second sleeve 817, and an end face of distal end 873 of shank 859 of second safety pin 857B is flush with the end face of first end 819 of second sleeve 817.

According to the form shown, safety device 801 further includes a safety spring 893 mounted in larger section 811 of first sleeve 803 and having first and second ends 895 and 897. First end 895 of safety spring 893 presses against end face 875 of first safety pin 857A, and second end 897 of safety spring 893 presses against end face 875 of second safety pin 857B (FIG. 7). Thus, safety spring 893 biases first safety pin 857A towards one of sidewalls 22 of base 20 and biases second safety pin 857B towards the other sidewall 22 of base 20. However, first and second safety pins 857A and 857B are still stopped by first and second stops 877A and 877B, such that distal ends 873 of first and second safety pins 857A and 857B are in retracted positions in first and second sleeves 803 and 817 and, thus, can not extend beyond first and second sleeves 803 and 817 (FIGS. 7 and 9). Namely, movable member 50 can move along first axis X between the disengagement position and the engagement position.

Figure 6:
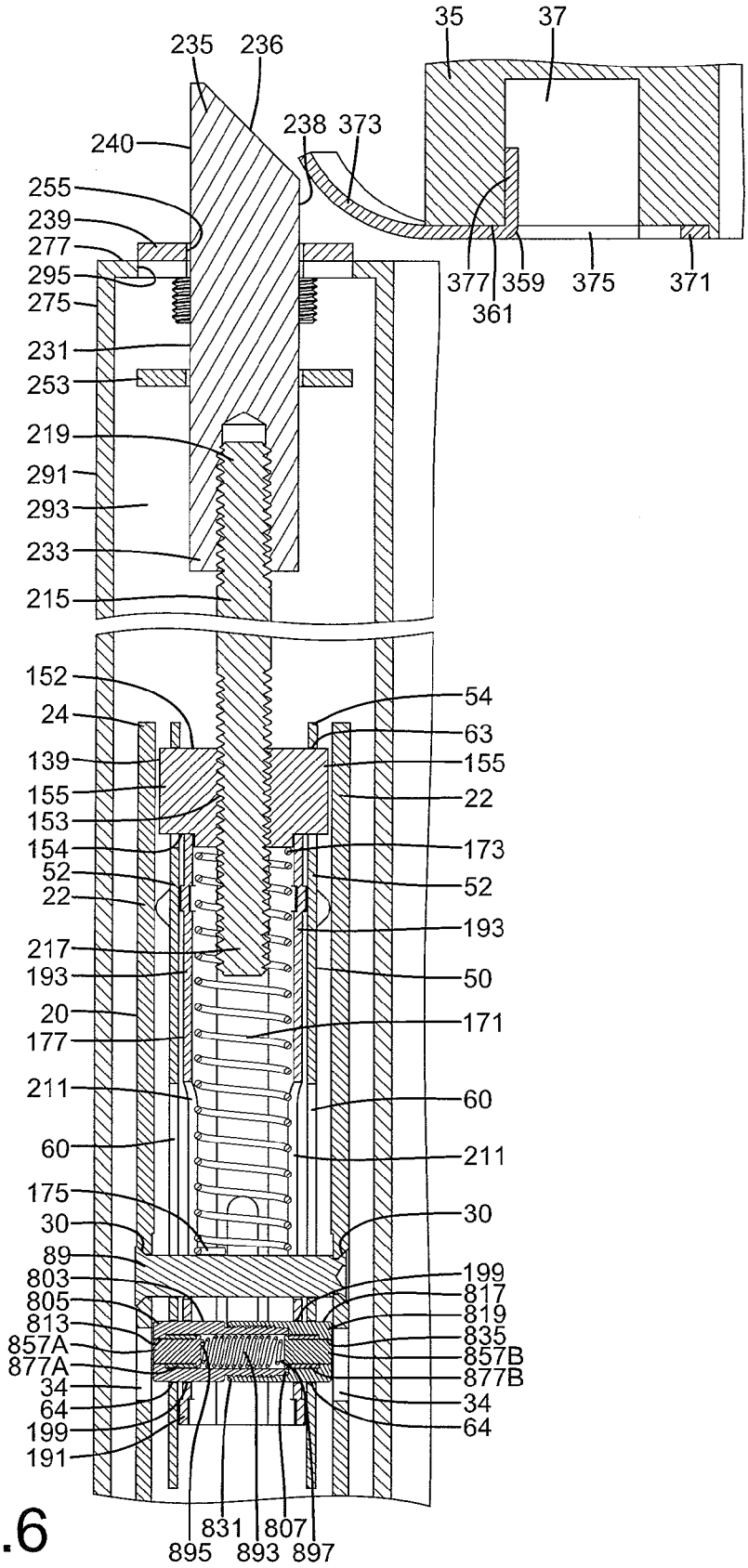
FIG. 6 shows a cross sectional view taken along section line 6-6 of FIG. 4.
Figure 10:
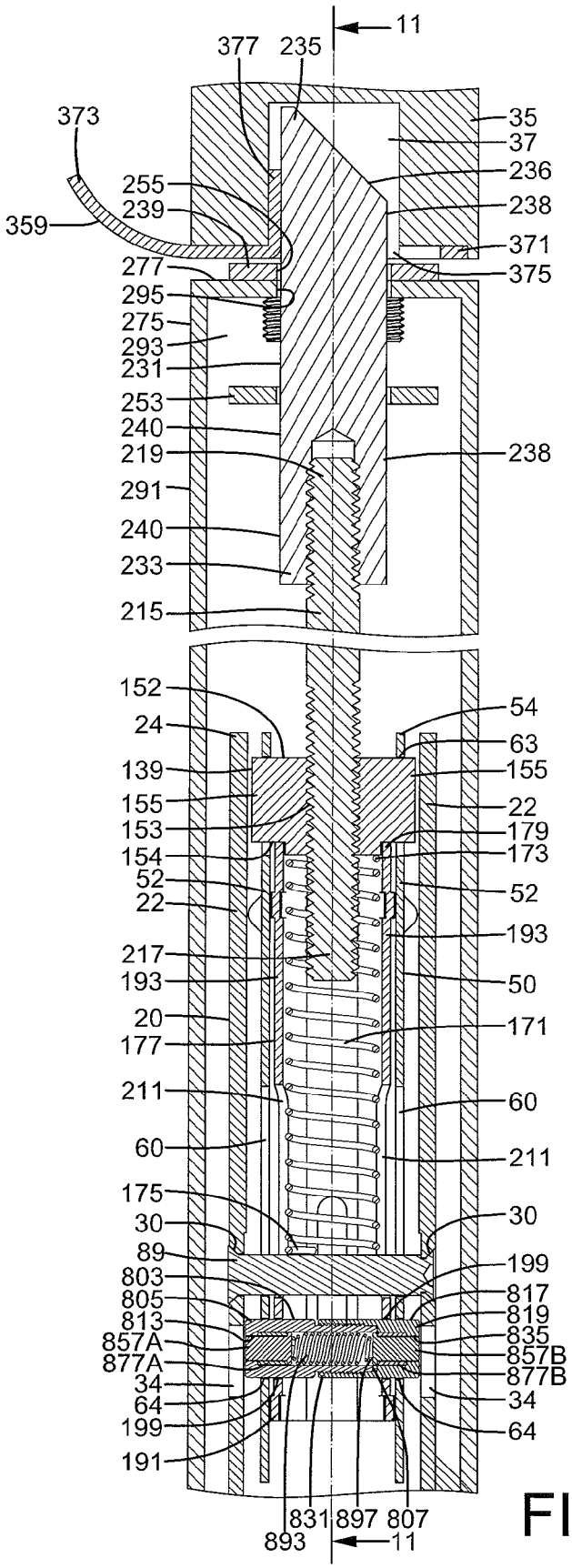
FIG. 10 shows a view similar to FIG. 8, with the follower door locked in place by the latch.

Safety device 801 is mounted in second mounting holes 64 of movable member 50 and mounting holes 199 of restraining member 177 (FIGS. 6 and 7), with first end 805 of first sleeve 803 extends through one of mounting hole 199 of restraining member 177 and one of second mounting holes 64 of movable member 50, with first end 819 of second sleeve 817 extending through the other mounting hole 199 of restraining member 177 and the other second mounting hole 64 of movable member 50, and with safety device 801 located between sidewalls 22 of base 20. Movable member 50 and restraining member 177 are connected together by safety device 801 and jointly movable along first axis X between the disengagement position (FIG. 9) and the engagement position (FIG. 5). When movable member 50 is in the engagement position, first and second safety pins 857A and 857B of safety device 801 are aligned with coupling holes 34 (FIGS. 5, 6, and 10). When movable member 50 is in the disengagement position, first and second safety pins 857A and 857B of safety device 801 are not aligned with coupling holes 34 (FIGS. 8 and 9).

Now that the basic construction of latch assembly 10 has been explained, the operation and some of the advantages of latch assembly 10 can be set forth and appreciated. In particular, for the sake of explanation, it will be assumed that primary door 259 is in an open position and the follower door 275 is in the open position (FIGS. 5 and 6). Latch 231 is not aligned with groove 37 of top beam 35 of door frame 31. End face 273 of primary door 259 is not aligned with end face 291 of follower door 275. Actuating latch 131 is not pressed and is in the releasing position (FIG. 5). Movable member 50 is in the engagement position. Latch 231 is in the latching position. Limiting member 90 is in the unlocking position such that engagement end 94 of limiting member 90 is located outside of the movement path of the movable member 50 between the engagement position and the disengagement position. Thus, movable member 50 can be driven to move from the engagement position to the disengagement position. Furthermore, first protrusion 92 of limiting member 90 abuts against and is, thus, stopped by first side 144 of actuation latch 131, retaining limiting member 90 in the locking position. Specifically, first protrusion 92 should pivot along first axis X towards second side 146 of actuating latch 131 when it is intended to pivot limiting member 90 about the pivot axis defined by third pin 91 from the unlocking position to the locking position. However, first protrusion 92 is stopped by first side 144 of actuation latch 131 and, thus, retains the limiting member 90 in the unlocking position. Furthermore, when limiting member 90 is in the unlocking position, second protrusion 93 abuts against outer face 103B of first wall 103 of limiting frame 101 such that engagement end 94 of limiting member 90 in the unlocking position can not pivot about the pivot axis defined by third pin 91 in a direction away from intermediate wall 38 of base 20, reliably retaining limiting member 90 in the unlocking position.

When follower door 275 pivots from the open position to closed position about first axis X, slant face 236 of latch 231 is pressed against by extension 373 of strike 359, moving latch 231 from the latching position to the unlatching position. At the same time, connecting rod 215 moves together with locking block 139 and compresses spring 171. Locking block 139 and movable member 50 move jointly from the engagement position to the disengagement position, causing movement of restraining member 177 via safety device 801. When follower door 275 reaches a position in which an end face of locking end 235 of latch 231 abuts against base portion 371 of strike 359, latch 231 is in the unlatching position (FIGS. 8 and 9). When follower door 275 keeps moving and reaches the closed position in which latch 231 is aligned with groove 37 of top beam 35, spring 171 biases locking block 139, causing movable member 50, restraining member 177, and safety device 801 to move along first axis X from the disengagement position to the engagement position. At the same time, connecting rod 215 moves together with locking block 139 to move latch 231 along first axis X from the unlatching position (FIGS. 8 and 9) to the latching position (FIGS. 10 and 11) in which latch 231 enters and engages with groove 37.

After follower door 275 reaches the closed position (FIG. 11) in which latch 231 is in the latching position and engages with groove 37, primary door 259 is moved to the closed position in which end face 273 of primary door 259 is aligned with end face 291 of follower door 275. Latch 333 of door lock 319 is engaged in receptacle 294 of follower door 275, and second opening 49 of faceplate 46 is covered by end face 273 of primary door 259, such that movable member 50 can not be moved to the disengagement position via actuating groove 70. Furthermore, end face 273 of primary door 259 presses against one of actuating faces 135 of actuation latch 131, causing actuation latch 131 to move along third axis Z from the releasing position towards the pressing position while compressing spring 335. After end face 273 of primary door 259 is aligned with end face 291 of follower door 275 (FIG. 12), actuation latch 131 is in the pressing position, and groove 142 of actuation latch 131 is aligned with first protrusion 92 of limiting member 90. Due to the gravitational force of engagement end 94, limiting member 90 pivots about the pivot axis defined by third pin 91 from the unlocking position (FIG. 11) to the locking position (FIG. 12) in which engagement end 94 engages with positioning groove 39 of base 20. In this case, second protrusion 93 of limiting member 90 is spaced from outer face 103B of limiting frame 101, and engagement end 94 of limiting member 90 is in the movement path of movable member 50 between the engagement position and the disengagement position. Namely, engagement end 94 of limiting member 90 is located below second end 66B of connecting portion 66 of movable member 50 along first axis X. Thus, movement of movable member 50 from the engagement position to the disengagement position is stopped by limiting member 90, avoiding movement of latch 231 to the unlatching position. Picking of latch 231 is, thus, avoided.

Figure 11:
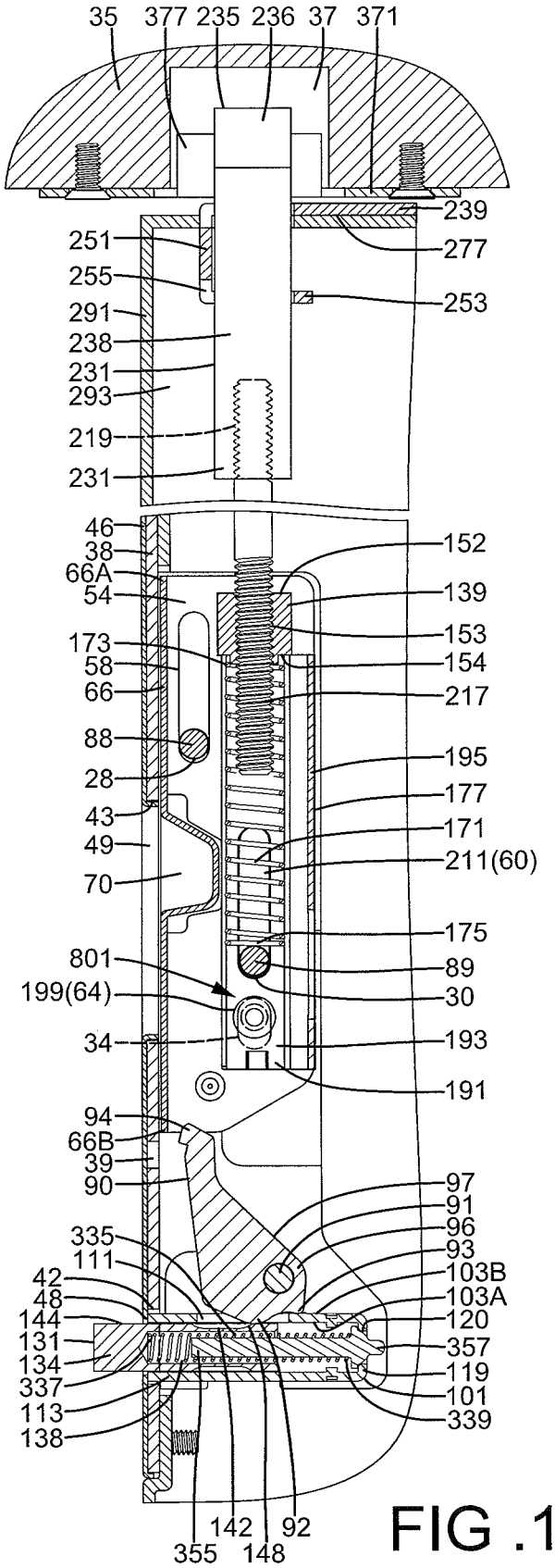
FIG. 11 shows a cross sectional view taken along section line 11-11 of FIG. 10.

Latch 231 can not be moved from the latching position to the unlatching position while that both of primary door 259 and follower door 275 are in their closed positions. When it is desired to move latch 231 from the latching position to the unlatching position, handle 331 of door lock 319 must be pivoted to retract latch 333, and primary door 259 must be moved to a position in which end face 273 of primary door 259 is spaced from end face 291 of follower door 275 to allow access to actuating groove 70 of movable member 50 via engagement hole 297 of follower door 275 (FIG. 11). Actuation latch 131 is moved from the pressing position to the releasing position under action of spring 335. Inclined section 148 of groove 142 of actuation latch 131 pushes first protrusion 92 of limiting member 90, causing pivotal movement of limiting member 90 from the locking position to the unlocking position about the pivot axis defined by third pin 91. Thus, a user can extend his or her finger into actuation groove 70 to move movable member 50 from the engagement position to the disengagement position about first axis X, moving latch 231 from the latching position to the unlatching position. Then, follower door 275 can be moved from the closed position to the open position.

In a case that a fire occurs while both of follower door 275 and primary door 259 are in their closed positions in which end face 273 of primary door 259 is aligned with end face 273 of follower door 275 and in which latch 231 is in the latching position engaged with groove 37, first and second stops 877A and 877B of safety device 801 made of plastic melt due to the heat of the fire. First safety pin 857A is moved from the retracted position to an extended position into one of coupling holes 34 of base 20 under the action of safety spring 893. Likewise, second safety pin 857B is moved from the retracted position to an extended position into the other coupling hole 34 of base 20 under the action of safety spring 893. Thus, movable member 50 is retained in the engagement position, retaining latch 231 in the latching position. Thus, primary door 259 can not be opened during the fire even if latch 333 of door lock 319 is retracted, avoiding spread of the fire by avoiding opening of double door 257.

Latch assembly 10 can prevent limiting member 90 from moving to the locking position while primary door 259 is in the closed position, such that latch 231 can not be moved from the latching position to the unlatching position by picking. Furthermore, when limiting member 90 is in the locking position, even if latch 231 is picked to cause movement of movable member 50 from the engagement position to the disengagement position, since second end 66B of connecting portion 66 of movable member 50 presses against outer periphery 97 of limiting member 90 whose engagement end 94 is engaged in positioning groove 39 of intermediate wall 38 of base 20, the force from movable member 50 will be imparted to intermediate wall 38 of base 20 and follower door 275, reducing the force imparted to third pin 91. Thus, latch assembly 10 provides reliable anti-picking effect. Furthermore, safety device 801 is aligned with coupling holes 34 of base 20 when latch 231 is in the latching position. When a fire occurs, first and second safety pins 857A and 857B of safety device 801 extend into coupling holes 34 to retain latch 231 in the latching position, avoiding spread of fire by preventing follower door 275 from being opened.

Now that the basic teachings of the present invention have been explained, many extensions and variations will be obvious to one having ordinary skill in the art. For example, latch assembly 10 does not have to include safety device 801 when it is not necessary to retain latch 231 in the latching position during a fire. Restraining member 177 can be fixed by screws to lateral walls 52 of movable member 50. Furthermore, latch assembly 10 does not have to include coupling member 237. In this case, follower door 275 includes a hole through which latch 231 passes to engage with groove 37. Further, latch assembly 10 does not have to include faceplate 46 without causing adverse affect to operation of latch assembly 10. Further, latch assembly 10 does not have to include strike 359. However, slant face 236 of latch 231 must be aligned with top beam 35 of door frame 31. When follower door 275 pivots from the open position to the closed position, latch 231 can still move from along first axis X from the latching position to the unlatching position after slant face 236 of latch 231 abuts against top beam 35. Further, latch assembly 10 does not have to include restraining member 177. In this case, lateral walls 52 of movable member 50 can have L-shaped cross sections, with spring 171 located between connecting portion 66 and L-shaped lateral walls 52, avoiding distortion of compressed spring 171. Further, base 20 does not have to include positioning groove 39. In this case, when limiting member 90 pivots to the locking position, engagement end 94 of limiting member 90 is still in the movement path of movable member 50 between the engagement position and the disengagement position, avoiding movement of movable member 50 from the engagement position to the disengagement position.

Furthermore, limiting member 90 does not have to include second protrusion 93. In this case, a wall can be formed on outer face 103B of first wall 103 of limiting frame 101 and located between slot 111 and connecting wall 119. When limiting member 90 is in the unlocking position, outer periphery 97 of limiting member 90 abuts against the wall to prevent engagement end 94 of limiting member 90 in the unlocking position from pivoting further about the pivot axis defined by third pin 91 in a direction away from intermediate wall 38 of base 20.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch assembly comprising:

a base (20) including two sidewalls (22) and an intermediate wall (38) extending between the two sidewalls (22), with each of the two sidewalls (22) including first, second, and third engagement holes (28, 30, 32), with the second engagement hole (30) located between the first engagement hole (28) and the third engagement hole (32) along a first axis (X), with first and second slots (36, 43) defined in the intermediate wall (38) and spaced from each other along the first axis (X), with the intermediate wall (38) of the base (20) adapted to be mounted to an end face (291) of a follower door (275) of a double door (257), with the follower door (275) including an interior space (293), with the two sidewalls (22) adapted to be received in the interior space (293) of the follower door (275), with the follower door (275) pivotable between a closed position and an open position;

a movable member (50) movably received between the two sidewalls (22) of the base (20), with the movable member (50) including two lateral walls (52) spaced from each other along a second axis (Y) perpendicular to the first axis (X), with the movable member (50) further including a connecting portion (66) extending between the two lateral walls (52), with each of the two lateral walls (52) including a first end (54) and a second end (56) spaced from the first end (54) along the first axis (X), with a first sliding groove (58) defined in the first end (54) of each of the two lateral walls (52), with a second sliding groove (60) defined between the second end (56) and the first sliding grooves (58) of each of the two lateral walls (52), with the connecting portion (66) including first and second ends (66A, 66B) spaced from each other along the first axis (X), with an actuating groove (70) defined in the connecting portion (66) and located between the first end (66A) of the connecting portion (66) and the second sliding groove (60) of each of the two lateral walls (52) along the first axis (X), with the first engagement holes (28) of the two sidewalls (22) of the base (20) aligned with the first sliding grooves (58) of the two lateral walls (52) of the movable member (50), with the second engagement holes (30) of the two sidewalls (22) of the base (20) aligned with the second sliding grooves (60) of the two lateral walls (52) of the movable member (50), with the actuating groove (70) aligned with the second slot (43);

a first pin (88) extending through the first engagement holes (28) of the two sidewalls (22) of the base (20) and the first sliding grooves (58) of the two lateral walls (52) of the movable member (50);

a second pin (89) extending through the second engagement holes (30) of the two sidewalls (22) of the base (20) and the second sliding grooves (60) of the two lateral walls (52) of the movable member (50), with the movable member (50) movable between an engagement position and a disengagement position along the first axis (X), with a spacing between the first end (66A) of the connecting portion (66) of the movable member (50) in the engagement position and the first end (24) of each of the two sidewalls (22) of the base (20) being smaller than a spacing between the first end (66A) of the connecting portion (66) of the movable member (50) in the disengagement position and the first end (24) of each of the two sidewalls (22) of the base (20), with the actuating groove (70) remaining in a length of the second slot (43) along the first axis (X);

a limiting member (90) pivotably received in the base (20) and having an outer periphery (97), with the limiting member (90) further including an engagement end (94) and a pivotal portion (96), with a first protrusion (92) formed on the outer periphery (97) and located adjacent to the pivotal portion (96), with the engagement end (94) facing the intermediate wall (38) of the base (20);

a third pin (91) extending through the third engagement holes (32) of the two sidewalls (22) of the base (20) and the pivotal portion (96) of the limiting member (90), with the limiting member (90) pivotable between a locking position and an unlocking position about a pivot axis defined by the third pin (91);

a limiting frame (101) fixed between the two sidewalls (22) of the base (20), with the limiting frame (101) including a first wall (103) and a second wall (113) spaced from the first wall (103) along the first axis (X), with the limiting frame (101) further including a connecting wall (119) extending between the first and second walls (103, 113), with the first wall (103) including an inner face (103A) and an outer face (103B) spaced from the inner face (103A) along the first axis (X), with a slot (111) extending from the inner face (103A) through the outer face (103B) of the first wall (103), with the first and second walls (103, 113) fixed to the intermediate wall (38) of the base (20), with the first protrusion (92) of the limiting member (90) extending through the slot (111) and received between the first and second walls (103, 113), with the engagement end (94) of the limiting member (90) located outside of the limiting frame (101);

an actuation latch (131) movably received in the first slot (36) of the base (20), with the actuation latch (131) including a base portion (132) having first and second ends (133, 137) spaced from each other along a third axis (Z) perpendicular to the first and second axes (X, Y), with the base portion (132) further including first and second sides (144, 146) spaced from each other along the first axis (X), with a wedge (134) formed on the second end (137) of the actuation latch (131), with a groove (142) formed in the first side (144) but spaced from the second side (146), with the groove (142) including a bottom wall having an inclined section (148) intersecting with the first side (144), with the actuation latch (131) movable along the third axis (Z) between a releasing position in which the wedge (134) is located outside of the base (20) and a pressing position in which the wedge (134) is received in the base (20), with the actuation latch (131) adapted to be actuated by an end face (273) of a primary door (259) of the double door (257), wherein when the follower door (275) is in the closed position and when the end face (273) of the primary door (259) is aligned with the end face (291) of the follower door (275), the end face (273) of the primary door (259) presses against the actuation latch (131), moving the actuation latch (131) from the releasing position to the pressing position;

a first spring (335) mounted between the actuating latch (131) and the connecting wall (119) of the limiting frame (101), with the first spring (335) biasing the actuation latch (131) from the pressing position to the releasing position;

a locking block (139) fixed to the movable member (50), with the locking block (139) including a locking hole (153), with the locking block (139) and the movable member (50) jointly movable between the engagement position and the disengagement position, with the locking block (139) spaced from the third pin (91) along the first axis (X);

a second spring (171) mounted between the locking block (139) and the second pin (89), with the second spring (171) biasing the locking block (139) and the movable member (50) from the disengagement position to the engagement position;

a connecting rod (215) including a first end (217) engaged in the locking hole (153) of the locking block (139) and a second end (219);

a latch (231) including an engagement end (233) fixed to the second end (219) of the connecting rod (215), with the latch (231) further including a locking end (235) having a slant face (236), with the latch (231) movable between a latching position and an unlatching position along the first axis (X), with the locking end (235) of the latch (231) in the unlatching position being adapted to be received in the follower door (275), with the locking end (235) of the latch (231) in the latching position adapted to extend out of the follower door (275) into a groove (37) in a door frame (31) to which the double door (257) is pivotably mounted;

wherein when the follower door (275) is in the open position, the latch (231) is not aligned with the groove (37), wherein when the follower door (275) is in the closed position, the latch (231) is aligned with the groove (37), wherein when the follower door (275) moves from the open position to the closed position, the slant face (236) of the latch (231) presses against the door frame (31), causing movement of the latch (231) from the latching position to the unlatching position, and the latch (231) is moved to the latching position under action of the second spring (171) when the follower door (275) is in the closed position, wherein when the end face (273) of the primary door (259) is not aligned with the end face (291) of the follower door (275), the actuation latch (131) is in the releasing position, the first protrusion (92) of the limiting member (90) abuts against the first side (144) of the actuation latch (131), the limiting member (90) is in the unlocking position, the engagement end (94) of the limiting member (90) is located outside of a movement path of the movable member (50) between the engagement position and the disengagement position, allowing the movable member (50) to be moved from the engagement position to the disengagement position via the actuating groove (70) to cause movement of the latch (231) from the latching position to the unlatching position, wherein when the end face (273) of the primary door (259) is aligned with the end face (291) of the follower door (275), the actuation latch (131) is in the pressing position and compresses the first spring (335), the groove (142) of the actuation latch (131) is aligned with the first protrusion (92) of the limiting member (90), the limiting member (90) is in the locking position, the engagement end (94) of the limiting member (90) is located in the movement path of the movable member (50), preventing the movable member (50) from being moved from the engagement position to the disengagement position via the actuating groove (70) to avoid the latch (231) from moving form the latching position to the unlatching position, avoiding picking of the latch (231), wherein when the actuation latch (131) is in the pressing position, if the primary door (259) is moved to a position in which the end face (273) of the primary door (259) is not aligned with the end face (291) of the follower door (275), the actuation latch (131) is moved by the first spring (335) from the pressing position to the releasing position, the first inclined section (148) of the actuation latch (131) pushes the first protrusion (92) of the limiting member (90), causing movement of the limiting member (90) from the locking position to the unlocking position about the pivot axis defined by the third pin (91), allowing movement of the movable member (50) from the engagement position to the disengagement position.

2. The latch assembly as claimed in claim 1, with a first mounting hole (63) defined in the first end (54) of each of the two lateral walls (52) of the movable member (50), with the locking block (139) including first and second ends (155) spaced from each other along the second axis (Y), with the first and second ends (155) of the locking block (139) respectively engaged in the first mounting holes (63) of the two lateral walls (52) of the movable member (50) to allow joint movement of the locking block (139) and the movable member (50) between the engagement position and the disengagement position.

3. The latch assembly as claimed in claim 2, with each of the two sidewalls (22) of the base (20) further including a coupling hole (34) located between the second engagement hole (30) and the third engagement hole (32), with each of the two lateral walls (52) of the movable member (50) further including a second mounting hole (64) located between the second end (56) thereof and the second sliding groove (60) thereof, with the latch assembly further comprising:

a first sleeve (803) including first and second ends (805, 807) spaced along the second axis (Y), with a receiving hole (809) extending from the first end (805) through the second end (807) of the first sleeve (803), with the receiving hole (809) including a smaller section (813) extending from the first end (805) towards but spaced from through the second end (807) of the first sleeve (803) and a larger section (811) extending from the second end (807) through the smaller section (813) and having a diameter larger than the smaller section (813), with the first end (805) of the first sleeve (803) extending through the second mounting hole (64) of one of the two lateral walls (52) of the movable member (50);

a second sleeve (817) including first and second ends (819, 831) spaced along the second axis (Y), with a mounting hole (833) extending from the first end (819) through the second end (831) of the second sleeve (817), with the mounting hole (833) including a first hole section (835) extending through the first end (819) of the second sleeve (817), with the mounting hole (833) further including a second hole section (837) extending through the second end (831) of the second sleeve (817), with the second end (831) of the second sleeve (817) engaged with the second end (807) of the first sleeve (803), with the first end (819) of the second sleeve (817) extending through the second mounting hole (64) of another of the two lateral walls (52) of the movable member (50), with the first ends (805) of the first and second sleeves (803, 817) located between the two sidewalls (22) of the base (20);

a first stop (877A) having a melting point lower than the first and second sleeves (803, 817), with the first stop (877A) received in the larger section (811) of the receiving hole (809) of the first sleeve (803);

a second stop (877B) having a melting point lower than the first and second sleeves (803, 817), with the second stop (877B) received in the mounting hole (833) of the second sleeve (817);

a first safety pin (857A) received in the receiving hole (809) of the first sleeve (803), with the first safety pin (857A) including a first shank (859) having a first distal end (873), with the first safety pin (857A) further including a first flange (871) formed on an end of the first shank (859) opposite to the first distal end (873) and having a diameter larger than a diameter of the first shank (859), with the first shank (859) of the first safety pin (857A) extending through the first stop (877A) into the smaller section (813) but not extending beyond the first end (805) of the first sleeve (803), with the first stop (877A) located between the first flange (871) of the first safety pin (857A) and the smaller section (813) of the first sleeve (803);

a second safety pin (857B) received in the mounting hole (833) of the second sleeve (817), with the second safety pin (857B) including a second shank (859) having a second distal end (873), with the second safety pin (857B) further including a second flange (871) formed on an end of the second shank (859) opposite to the second distal end (873) and having a diameter larger than a diameter of the second shank (859), with the second shank (859) of the second safety pin (857B) extending through the second stop (877B) into the first hole section (835) but not extending beyond the first end (819) of the second sleeve (817), with the second stop (877B) located between the second flange (871) of the second safety pin (857B) and the first hole section (835) of the second sleeve (817);

a safety spring (893) mounted in the larger section (811) of the receiving hole (809) of the first sleeve (803), with the safety spring (893) including a first end (895) pressing against the first flange (871) of the first safety pin (857A) and a second end (897) pressing against the second flange (871) of the second safety pin (857B), with the safety spring (893) biasing the first and second safety pins (857A, 857B) towards the two sidewalls (22) of the base (20), with the first and second safety pins (857A, 857B) being aligned with the coupling holes (34) of the two sidewalls (22) of the base (20) when the latch (231) is in the latching position, with the latch (231) in the latching position and with the first and second stops (877A, 877B) melted by heat, the safety spring (893) moves the first distal end (873) of the first safety pin (857A) and the second distal end (873) of the second safety pin (857B) into the coupling holes (34) of the two sidewall (22) of the base (20), retaining the movable member (50) in the engagement position to retain the latch (231) in the latching position.

4. The latch assembly as claimed in claim 3, further comprising:

a restraining member (177) mounted in the movable member (50), with the restraining member (177) including two sides (193) spaced from each other along the second axis (Y), with each of the two sides (193) having first and second ends (179, 191) spaced from each other along the first axis (X), with the restraining member (177) further including a connecting section (195) extending between the two sides (193), with a mounting hole (199) defined in the second end (191) of each of the two sides (193) of the restraining member (177), with each of the two sides (193) of the restraining member (177) further including a slot (211) between the mounting hole (199) and the first end (179) of the side (193) of the restraining member (177), with the slots (211) of the restraining member (177) aligned with the second sliding grooves (60) of the two lateral walls (52) of the movable member (50), and with the mounting holes (199) of the restraining member (177) aligned with the second mounting holes (64) of the two lateral walls (52) of the movable member (50), with the first spring (171) received in a space defined by the sides (193) and the connecting section (195) of the restraining member (177), with the second pin (89) extending through the slots (211) of the restraining member (177), with the first end (805) of the first sleeve (803) extending through one of the mounting hole (199) of one of the two sides (193) of the restraining member (177), with the first end (819) of the second sleeve (817) extending through the mounting hole (199) of another of the two sides (193) of the restraining member (177), with the slots (211) of the restraining member (177) allowing joint movement of the restraining member (177) and the movable member (50) between the engagement position and the disengagement position, with the restraining member (177) avoiding distortion of the second spring (171) while the movable member (50) moves towards the engagement position and compresses the second spring (171).

5. The latch assembly as claimed in claim 1, with the limiting member (90) further including a second protrusion (93) formed on the outer periphery (97) and located between the first protrusion (92) and the pivotal portion (96)*m* wherein when the limiting member (90) is in the unlocking position, the second protrusion (93) abuts against the outer face (103B) of the first wall (103) of the limiting frame (101), avoiding the engagement end (94) of the limiting member (90) in the locking position from pivoting about the pivot axis defined by the third pin (91) in a direction away from the intermediate wall (38) of the base (20).

6. The latch assembly as claimed in claim 1, with the intermediate wall (38) of the base (20) further including a positioning groove (39) located between the first and second slots (36, 43), with the engagement end (94) of the limiting member (90) engaged in the positioning groove (39) when the limiting member (90) is in the locking position.

7. The latch assembly as claimed in claim 1, with the connecting wall (119) of the limiting frame (101) including a positioning hole (120), with the first end (133) of the actuation latch (131) including a hole (138), with the latch assembly (10) further comprising: a guiding rod (351) mounted in the limiting frame (101), with the guiding rod (351) including a first positioning end (355) engaged in the hole (138) of the first end (133) of the actuation latch (131), with the guiding rod (351) further including a second positioning end (357) engaged in the positioning hole (120) of the limiting frame (101), with the first spring (335) mounted around the guiding rod (351), with the guiding rod (351) avoiding distortion of the first spring (335) while the actuation latch (131) moves towards the pressing position and compresses the first spring (335).

* * * * *